US007368685B2

(12) United States Patent
Nam et al.

(10) Patent No.: US 7,368,685 B2
(45) Date of Patent: May 6, 2008

(54) OVEN AND HEATING UNIT OF OVEN

(75) Inventors: Hyeum Sik Nam, Seoul (KR); Young Sok Nam, Seoul (KR); Yong Soo Lee, Sihoong-si (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 91 days.

(21) Appl. No.: 11/392,755

(22) Filed: Mar. 30, 2006

(65) Prior Publication Data

US 2007/0131670 A1 Jun. 14, 2007

(30) Foreign Application Priority Data

Dec. 12, 2005 (KR) ..... 10-2005-0121529

(51) Int. Cl.
*H05B 3/68* (2006.01)
*F27D 11/04* (2006.01)

(52) U.S. Cl. ..... 219/403; 219/780; 99/358; 39/338; 426/244

(58) Field of Classification Search ..... None
See application file for complete search history.

(56) References Cited

U.S. PATENT DOCUMENTS

| | | | | | |
|---|---|---|---|---|---|
| 1,208,637 | A | * | 12/1916 | Phelps | 219/396 |
| 1,380,656 | A | * | 6/1921 | Lauth | 99/358 |
| 2,269,178 | A | * | 1/1942 | Breneman | 99/358 |
| 3,245,338 | A | * | 4/1966 | Korr | 99/358 |
| 3,565,642 | A | * | 2/1971 | Hirsch | 99/358 |
| 3,771,433 | A | * | 11/1973 | King | 99/358 |
| 6,864,468 | B2 | | 3/2005 | Kim et al. | |

* cited by examiner

*Primary Examiner*—J. Pelham
(74) *Attorney, Agent, or Firm*—Greenblum & Bernstein, P.L.C.

(57) ABSTRACT

An oven and a heating unit of the oven are provided. The oven includes a cavity, a heater, a food container, and an ohmic heater. A high temperature environment is formed in the cavity. The food container is mounted within the cavity to receive food therein. The ohmic heater is formed in the food container and allows power to be supplied to the food so that the food may be directly heated.

24 Claims, 5 Drawing Sheets

OVEN AND HEATING UNIT OF OVEN

BACKGROUND OF THE INVENTION

1. Field of the Invention

The present invention relates to an oven, and more particularly, to a heating unit of an oven, capable of efficiently heating food put in the inside of the oven. The present invention still more particularly relates to an oven and a heating unit of the oven, capable of more swiftly performing cooking of food and improving an operation efficiency of the oven through an appropriate heating method.

2. Description of the Related Art

An oven cooks food by providing a high temperature environment in the inside of a cavity, and is used for any item as well as food requiring high temperature. A heating unit is mounted in the inside of the oven to provide a high temperature environment in the inside of the oven. The heating unit may be one or more heaters and/or a magnetron. Heat and/or electro-magnetic wave generated from the heater and/or the magnetron is delivered to an item such as food to heat the item.

The heater will be described in more detail.

The heater of the oven includes a heat generating body to which power applied from the outside is delivered. The heat generated from the heat generating body is delivered to food through radiation and convection. The oven operates in this manner. Since heat may be delivered to other parts of the oven, not the food while the heat is delivered to the food through the radiation and the convection, a heating efficiency of the food by the heater may decrease. That is, the heat generated from the heat generating body may not be efficiently used but just discarded. Also, even when heating is performed using electro-magnetic waves generated from the magnetron, part of the electro-magnetic waves are not delivered to food but to other parts of the oven, so that a heating efficiency of the food by the magnetron may also decrease. Also, when the electro-magnetic waves generated from the magnetron leak from the cavity, the leaked electromagnetic waves are harmful to a human body and a safety problem is generated.

As described above, since the heat generated from the heater is delivered to the food through a predetermined medium such as air in the heater used for the related art oven, the amount of heat directly delivered to the food is small, which decreases an operation efficiency of the oven.

Also, since heat applied from the heater is delivered to only the surface of the food, the inner portion of the food is not properly heated. Therefore, frequently, even when the surface of the food is properly cooked, the inner portion of the food may be not sufficiently cooked. Furthermore, regarding the surface of the food, a surface on which heat is directly applied, e.g., a part facing the heater is sufficiently heated but a lower side portion contacting a pan, or left/right side portions may not be sufficiently heated frequently.

Also, when the low amount of heat is applied for a long time in order to cook even the inner portion of the food, a cooking time is lengthened and thus a user inconvenience is generated.

SUMMARY OF THE INVENTION

Accordingly, the present invention is directed to an oven and a heating unit of the oven that substantially obviate one or more problems due to limitations and disadvantages of the related art.

An object of the present invention is to provide an oven and a heating unit of the oven, capable of sufficiently and swiftly heating even the inner portion of food as well as the surface of the food.

Another object of the present invention is to provide an oven and a heating unit of the oven, capable of uniformly heating even the surface of food as well as the inner portion of the food.

A further another object of the present invention is to provide an oven and a heating unit of the oven, capable of increasing the amount of heat directly delivered to food while reducing heat consumed in vain, thereby increasing an operation efficiency of the oven.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an oven including: a cavity where a high temperature environment is formed; a heater for heating an inside of the cavity through radiation or convection; a food container mounted within the cavity and in which food is contained; and an ohmic heater formed in the food container, for allowing power to be supplied to the food to directly heat the food.

In another aspect of the present invention, there is provided an oven including: a cavity having a cooking space in an inside thereof; a transformer provided to an outside of the cavity, for transforming a voltage of a power source applied from an outside; a pair of first connectors connected to an output terminal of the transformer and formed on a wall constituting the cavity; a food container provided to the inside of the cavity and where food is contained; a pair of second connectors formed on one side of the food container and selectively connected with the first connectors, for receiving power; and at least one electrode connected with the second connectors, for contacting food to allow the food to be cooked by the self-resistance of the food.

In a further another aspect of the present invention, there is provided a heating unit of an oven, including: a pair of first connectors formed in one side of a cavity and to which power is applied; a food container mounted within the oven; a pair of second connectors formed in one side of the food container and aligned with the first connectors; and electrodes connected to each of the second connectors and formed on the bottom of the food container, wherein all or part of the electrodes contacts food to apply a voltage to the food seated on the food container and the food is cooked by the self-resistance of the food.

In a still further another aspect of the present invention, there is provided a heating unit of an oven, including: a food container drawably mounted in an inside of the oven; a pair of connectors formed in one side of the food container, for receiving power from the oven; a pair of electrodes, each being electrically connected to the pair of connectors and contacting food contained in the food container, for applying a voltage to the food; and a short-circuit prevention element provided in the food container, for preventing short circuit between the electrodes.

According to the present invention, it is possible to shorten a cooking time of food and sufficiently heat even the food's inner portion as well as the food's surface in a short period of time, so that the cooking time of the food is shortened even more.

Also, the present invention increases the amount of heat directly delivered to food to enhance an operation efficiency of the oven. Since the present invention increases an energy efficiency of an oven such as an electric oven where power consumption is great, the present invention is particularly applicable to an area where power is expensive.

Also, since the surface of food and the inner portion of the food are uniformly heated, the flavor of the food cooked in this manner may satisfy a user's taste even more.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
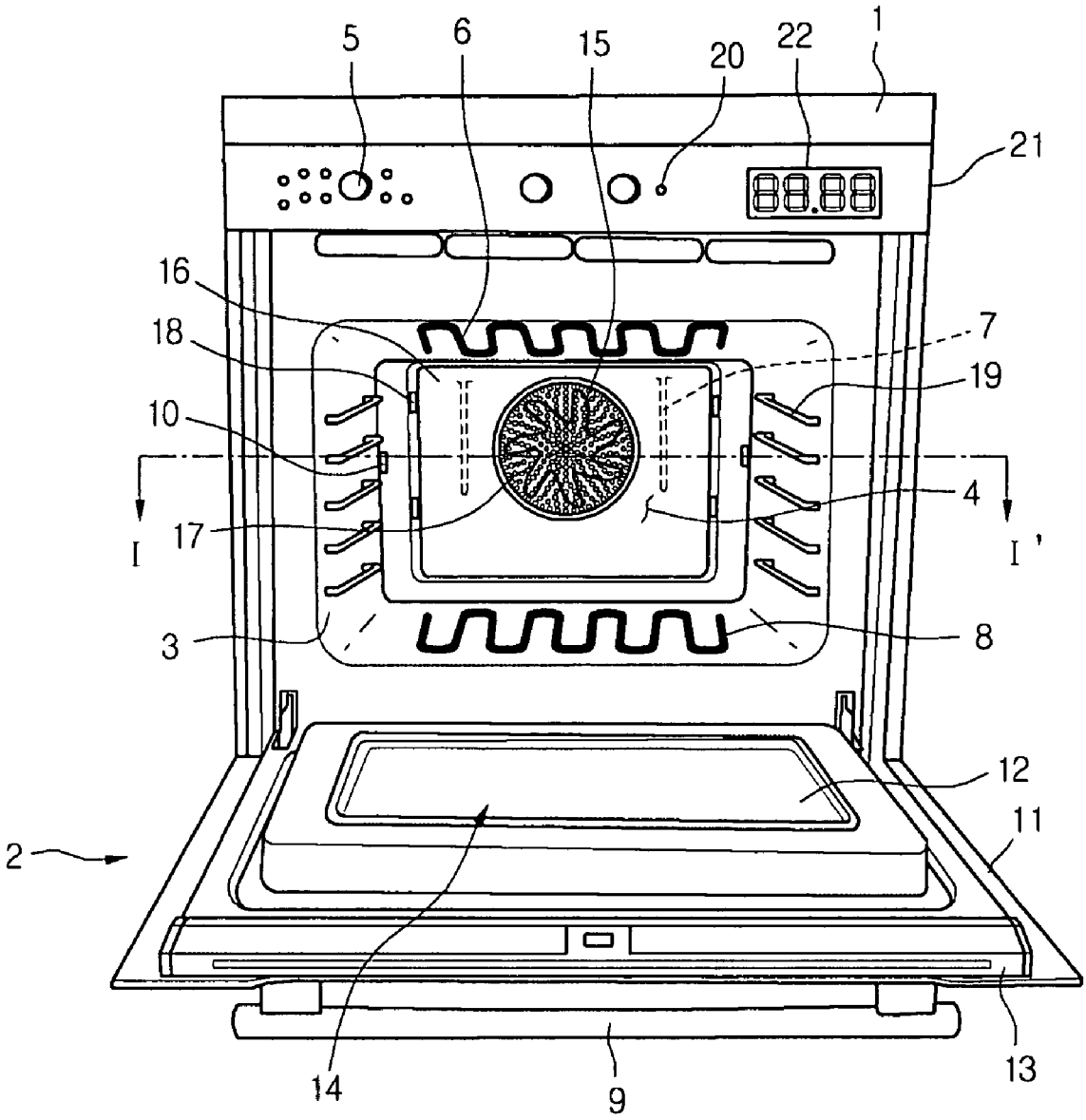
FIG. 1 is a front perspective view of an oven according to the present invention.

FIG. 1 is a front perspective view of an oven according to the present invention.

Referring to FIG. 1, the oven includes a main machine 1 having a cavity 4 therein, and a door 2 for selectively opening/closing an opening at the front of the cavity 4 so that food may be put into and out of the cavity 4.

In detail, the outermost portion of the main machine 1 is protected by a case 21, and a manipulation part 5 is formed on the upper front side of the case 21 to allow a user to control the operation of the oven. A display 22 is provided on one side of the manipulation part 5 to allow a user to observe the operation state of the oven. An inner space of the cavity 4 is separated from the outside by a wall 3, so that heat emission from the cavity 4 is blocked.

In more detail, the manipulation part 5 may include a dial switch. Generally, a user may turn the dial switch to manipulate the operation state of the oven. Predetermined button switches are further provided, so that an operation state assigned to one of the predetermined button switches may be on or off when a user presses the corresponding button switch. Furthermore, one of the button switches may be an ohmic heating button 20 to allow an ohmic heater to operate or stop. Detailed construction of the ohmic heater will be described later. Of course, the operation of the ohmic heater may be controlled by the above-described dial switch, not by the ohmic heating button 20.

A view window 14 is provided to the door 2 to allow a user to view the inside of the cavity 4, and a door handle 9 is provided to the front side of the door 2 to allow a user to manipulate the door 2. A plurality of glass, e.g., a front glass 11 and an inner glass 12 are provided in the door 2 to maintain the view window 14 transparent. A plurality of inner glass 12 may be collectively supported by a glass support frame 13.

Also, the inner structure of the cavity 4 will now be described in detail. A plurality of heater units heating the inner space of the cavity 4 are provided in the cavity 4. The heating units include an upper heater 6 placed on the upper side of the cavity 4, a lower heater 8 placed on the lower side of the cavity 4, and a convection heater 7 placed on the rear side of the cavity 4.

In detail, the upper heater 6, also called a broil heater, applies heat from the upper side to the lower side of the cavity 4, and changes the color of bread into brown. The lower heater 8, also called a bake heater, applies heat from the lower side to the upper side of the cavity 4, and bakes food.

Here, the upper and lower heaters 6 and 8 directly deliver radiation heat to food. On the other hand, the convection heater 7 generates heat to heat air to high temperature and delivers the heated air to food, thereby heating food using the high temperature air. The convection heater 7 is located in an inner space protected by a predetermined plate in the rear side of the cavity 4 in order to allow the convection heater 7 to operate properly. A convection fan 15 is placed at the center of the convection heater 7 to allow air in the inner space of the cavity 4 to flow to the convection heater 7, be heated there, and then go back to the inside of the cavity 4. A first communication hole 17 provided to a portion aligned with the convection fan 15, and a second communication hole 18 provided to the outside of the convection fan 15 are formed in order to constitute an inflow path and an outflow path of air in cooperation with the convection fan 15. It is natural that one of the communication holes 17 and 18 should become the inflow path of air communicating with the convection fan 15 and the other communication hole becomes the outflow path of air.

The convection heater 7, the upper heater 6, and the lower heater 8 may selectively operate depending on the kind of the food and a cooking method, so that cooking performance for food is optimized depending on the kind of the food. The convection heater 7, the upper heater 6, and the lower heater 8 are not indispensable elements and one of these heaters may be removed or reinforced depending on the specification of the oven.

In addition to the above-described heaters, the oven further includes an ohmic heater as another heater. The ohmic heater includes a first connector provided in a wall 3 of the cavity 4, and a second connector formed in a food container 40 of FIG. 3 mounted in the cavity 4. The first and second connectors will be described in detail below with reference to the accompanying drawings. The first connector may be protected by a protector 10 so that the first connector is not exposed to the outside when the food container 40 is not mounted in the inside of the cavity 4.

The operation of the ohmic heater will now be briefly described. When the food container 40 is mounted in the cavity 4, the first connector is connected with the second connector. Power is applied through these connectors and thus power is applied to the food container 40. The applied power is directly delivered to food, and thus passes through the food, which is heated by the resistance of the food. Since the power applied from the outside is directly delivered to the inside of the food, the food generates heat spontaneously and is heated by this generated heat. Therefore, power efficiency increases, not only the surface of the food but also the inside of the food is swiftly heated, and a cooking time is shortened. Of course, the operating of the ohmic heater does not exclude simultaneous operating of other heaters.

As described above, the ohmic component of the food is used, and a current is allowed to flow through the food so that cooking of the food is performed by the ohmic component of the food, hence the name ohmic heater.

The construction of a heating unit of the oven according to the present invention, defined as the ohmic heater will now be described below in more detail. Of courses, though the oven according to the present invention further includes structures in which the above-described upper heater, lower heater, and convection heater may be installed, such structures are widely known in the art, and thus detailed description thereof will be omitted.

Figure 2:
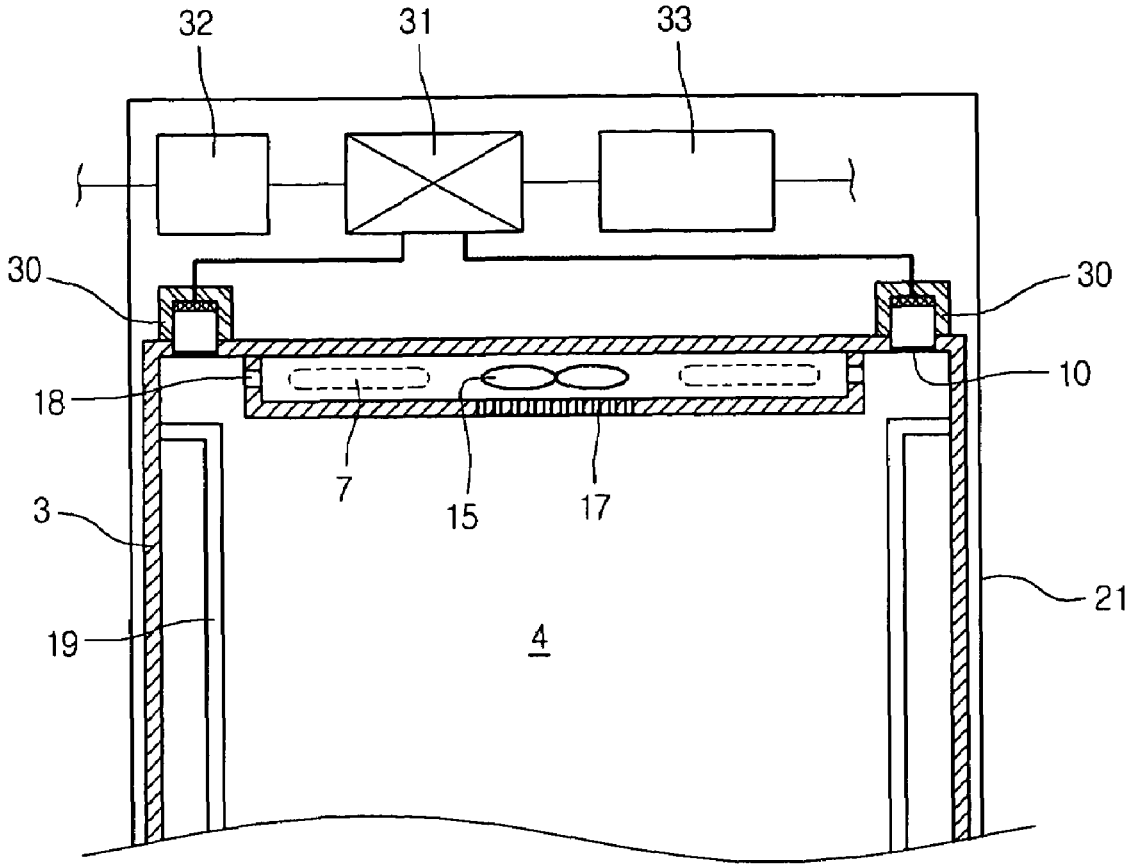
FIG. 2 is a sectional view of FIG. 1 taken along a line I-I'.
Figure 3:
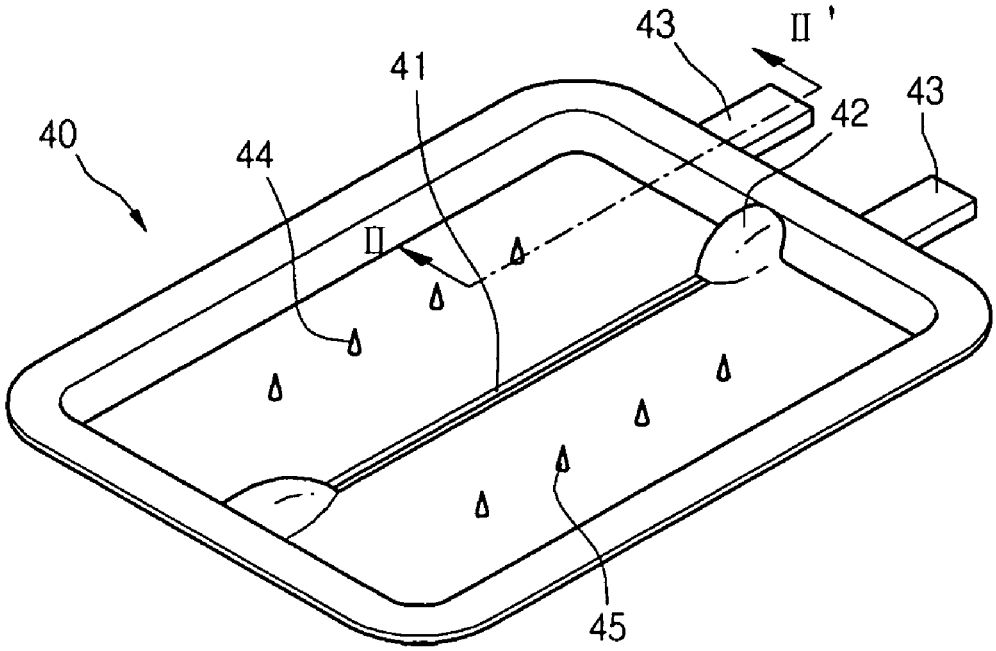
FIG. 3 is a perspective view of a food container mounted within an oven.

FIG. 2 is a sectional view of FIG. 1 taken along a line I-I', and FIG. 3 is a perspective view of a food container mounted within an oven.

Referring to FIGS. 2 and 3, the oven according to the present invention further includes a predetermined structure allowing the ohmic heater to be mounted as a heater. The food container 40 is received inside the cavity 4 as part constituting the ohmic heater.

The food container 40 is described. The food container 40 is formed in a pan shape such that the bottom of the food container 40 is recessed to a predetermined depth to receive food and the outer periphery of the food container 40 is embossed to a predetermined height. The bottom of the food container 40 is divided left and right by a slit 41, and embossing portions 42 are respectively embossed from both ends of the slit 41.

Also, a plurality of first electrodes 45 and a plurality of second electrodes 44 are protruded on both sides divided left and right by the slit 41. The electrodes 44 and 45 extend to the outside of the food container 40, i.e., to the rear side in FIG. 3 and are connected with a plug 43 serving as a second connector for applying power to the electrodes 44 and 45.

Also, a socket 30 into which the plug 43 is inserted is formed in the rear side of the cavity 4. The socket 30 is connected to a transformer 31, which receives power applied from a power supply 32. In detail, the amount of power is controlled by the transformer 31 such that power suitable for the size of food is supplied.

Figure 4:
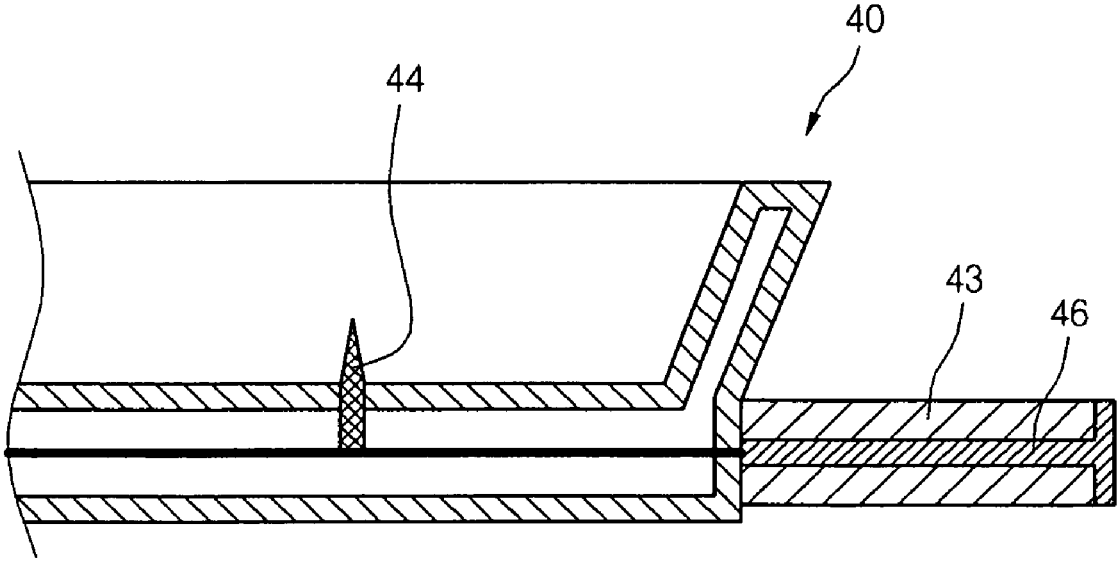
FIG. 4 is a sectional view of FIG. 3 taken along a line II-II'.

FIG. 4 is a sectional view of FIG. 3 taken along a line II-II'. Referring to FIG. 4, the electrodes 45 is connected with the plug 43 through a conductor 46, which extends through the inner space of the food container 40. The conductor 46 is also connected with all of the second electrodes 44, so that even when one of the electrodes 44 does not contact food, the other electrodes 44 may contact the food. Therefore, electrical connection between at least one of the plugs 43, the second electrodes 44, and food may be reliably made. Connection between the other plug 43 and the first electrodes 45 may be made in the same manner.

The first electrodes 45 and the second electrodes 44 may not be directly connected with each other but may be electrically connected with the slit 41 interposed therebetween. Therefore, when food is not placed in the food container 40, electricity does not flow. On the other hand, when the food is place in the food container 40, electricity flows through the food and cooking of the food is performed by the self-resistance of the food.

The plug 43 is connected with the socket 30, which is the first connector formed in the rear side of the cavity 4 to receive power from the outside. The construction of the main machine 1 of the oven associated with the first connector will be described in detail with reference to FIG. 2.

The oven includes the cavity defined by the inner space of the wall 3. Racks 19 for guiding a seating operation of the food container 40 are provided to the left and right sides of the cavity 4. When the food container 40 is guided by the racks 19 and inserted into the oven, the plug 43 formed in the rear side of the food container 40 may be smoothly inserted into the socket 30. For that purpose, the plug 43 may be aligned with the socket 30 at a position where the food container 40 is seated.

The socket 30 is formed in the outer side of the wall 3, and an opening where the plug 43 is inserted into the socket 30 is protected by the protector 10. In detail, with the protector, high temperature air in the cavity 4 does not directly flow to the inner space of the socket 30, so that durability of the socket 30 improves and the leakage of the high temperature air is prevented. For that purpose, the protector 10 may include a plate having a predetermined shape and a predetermined elastic element (not shown) allowing rotation of the plate. With such a construction, when the plug 43 is not inserted into the socket 30, the protector 10 blocks an open portion of the socket 30 so that heated air of the inside of the cavity 4 may not be delivered to the socket 30. When the plug 43 is introduced into the socket 30, the protector 10 is pushed backward to expose the open portion of the socket 30. Alternatively, the protector 10 may not include the elastic element and the open portion of the socket 30 may be exposed when the food container 40 is pushed into the cavity 4 and automatically closed due to the own weight of the protector when the food container 40 is drawn from the cavity 4.

The socket 30 is provided to a position at which the socket 30 is aligned with the plug 43 when the food container 40 is seated on one of the racks 19. Like the plug 43, the socket 30 is provided in pairs on both sides. Though not shown in the drawings, a plurality of socket pairs 30 may be provided to a plurality of positions, respectively, such that one of the sockets 30 is aligned with the plug 43 when the food container 40 is seated on corresponding one of the racks 19.

In detail, a pair of sockets 30 are connected to the transformer 31, which receives power applied from the power supply 32. The transformer 31 is controlled by a controller 33 of the oven to regulate the amount of power delivered to the socket 30. Therefore, it is possible to optimize the operation of the ohmic heater by controlling the amount of power provided from the transformer 31 depending on various conditions such as the state of food and a selected cooking speed. However, the transformer 31 may be omitted depending on the specification of the oven. For example, when the oven is designed with an ohmic heater having a constant power, the ohmic heater may be omitted.

The operation of the oven and the heating unit of the oven will now be described below in detail.

Food is seated on the food container 40. Here, the food is seated such that at least one side of the food contacts the first electrodes 45 and the other side of the food contacts the second electrodes 44. At this point, since pluralities of the electrodes 44 and 45 are provided, a user does not need to pay attention in order to allow the food to contact the electrodes. Also, since a current flows through the food through a plurality of points in the food, the food is uniformly heated.

After the food is placed in the food container 40, the food container 40 is guided by the racks 19 and inserted into the cavity 4. The plug 43 pushes the protector 10 and is inserted into the socket 30 through this insertion operation. Also, when the plug 43 is inserted into the socket 30 a predetermined depth, the plug 43 of the food container 40 contacts and is electrically connected with a terminal inside the socket 30 formed in the rear side of the cavity 4. Though a fitting operation between the socket 30 and the plug 43 may be realized in the same manner as that between a plug and a socket of a general electric product, the conductors of the socket 30 and the plug 43 may be protected by a fire-resistant material in consideration of the high temperature inner environment of the cavity 4.

After the food container 40 in which food is contained is received into the cavity 4, the door 2 is closed and the oven starts to operate. At this point, a user may manipulate the manipulation part 5 to operate the oven in various operation states. Particularly, a user may start the operation of the ohmic heater by pressing the ohmic heating button 20.

When manipulation information of the manipulation part 5 is delivered to the controller 33, the controller 33 controls the transformer 31 to regulate power applied to the ohmic heater. The regulation of the power by the transformer 31 may be performed in various ways. For example, the output of the transformer 31 may be controlled with reference to information of food inputted by the manipulation part 5. In detail, much power should be applied to the inside of food when an object to be cooked is food having a large volume or a large thickness, a voltage may be controlled by the transformer 31 such that a high voltage is applied to the socket 30. Of course, a low voltage may be applied to allow the oven to operate with low power.

A voltage applied to the socket 30 is delivered to the conductor 46 through the plug 43 and eventually delivered to one of the electrodes 44 and 45. Since the electrodes 44 and 45 are in contact with food, a current flows through one of the electrodes 44 and 45 and the food, and then flows through other electrodes. After that, a current flows through transformer 31 again via the socket 30 connected with other electrodes. At this point, flowing of a current through the food is due to water included in the inside of the food and ions dissolved in the water. A current delivered to the food may be an alternating current so that the ions are not electrolyzed by a current flowing through the food.

Since a current is directly applied to and flows through the food as described above, a current may directly flow through the inner portion of the food and the food may be cooked using heat generated by resistance of the food. Therefore, the even the inner portion of the food is swiftly heated and thus cooked. Also, since applied whole energy without power loss is used for generating heat using the food's own resistance, an energy efficiency remarkably improves.

Since the outside of the food is heated by other heaters and the inside of the food is heated by the ohmic heater, the inside and outside of the food are uniformly and sufficiently heated.

On the other hand, moisture has been frozen in frozen food, so that a current may not flow through the food during an early operating stage of the ohmic heater. However, when part of food starts to melt due to other heating source, a current continues to flow through the molten part of the food, generating heat, so that the food is cooked. Of course, using this characteristic, the oven of the present invention may be used as a defrosting apparatus.

Wile the food is cooked, moisture generated from the food may cause short circuit between the electrodes 44 and 45. To overcome this short-circuit problem, the slit 41 is formed between the electrodes 44 and 45. Also, it is possible to prevent the short circuit between the electrodes 44 and 45 by making generated moisture flow through the slit 41. The both ends of the slit 41 have shapes embossed upward by the embossing portions 42. Therefore, the generated moisture is not gathered to the both ends of the slit 41, so that electrical short circuit due to the moisture is prevented.

Here, the slit 41 and the embossing portions 42, which are structures for preventing short circuit between the electrodes 44 and 45, and improves electric reliability during a cooking operation of the food. Therefore, these elements may be defined as short-circuit prevention structures. Various short-circuit structures similar to those mentioned above may be proposed. For example, in the case where a pan includes a plurality of wires such wire racks, there does not exit any structure whatsoever where moisture stays to cause short circuit. In this case, the wire racks themselves serve as a short-circuit prevention structure.

Figure 5:
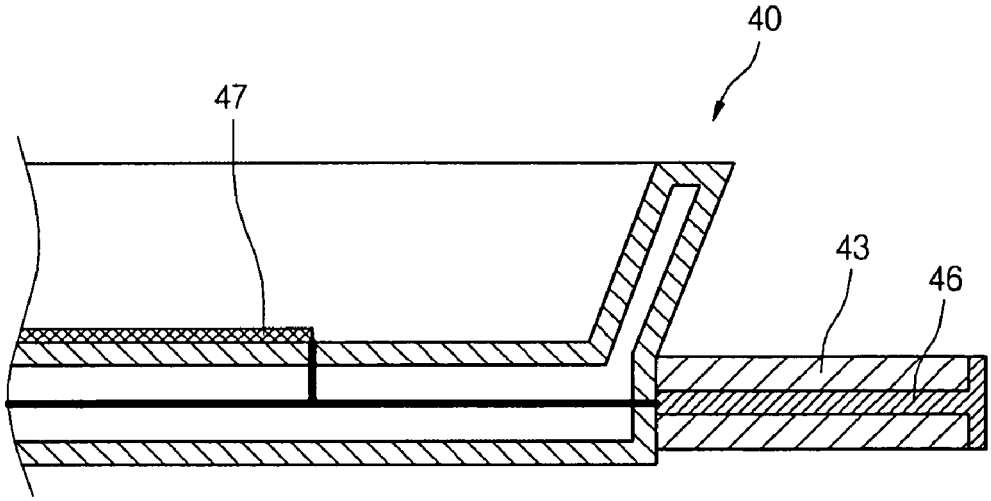
FIG. 5 is a sectional view of a food container according to another embodiment of the present invention.

FIG. 5 is a view of a food container according to another embodiment of the present invention, illustrating only the cross-section of the food container.

A sectional view of the food container cut in the same manner as illustrated in FIG. 4 is illustrated in the embodiment proposed in FIG. 5. Referring to FIG. 5, a plane-contact type or line-contact type extension electrode 47 formed over a relatively wide area is provided, instead of the plurality of electrodes 44 and 45 provided in the shapes of protuberances as illustrated in FIG. 4. The extension electrode 47 may include an electrode having a long line shape or a wide plane shape contacting the conductor 46 in order to increase contact reliability of the extension electrode 47 with respect to the food. When the extension electrode 47 is provided in the long line shape, a plurality of line-contact type extension electrodes 47 may be provided to enhance a contact reliability.

Figure 6:
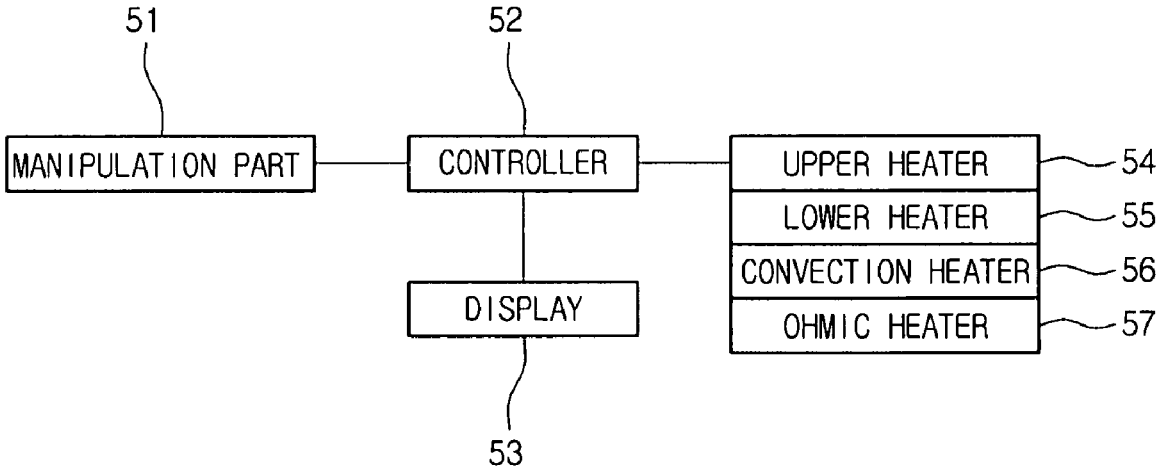
FIG. 6 is a block diagram of an oven according to the present invention.

FIG. 6 is a block diagram of an oven according to the present invention.

Referring to FIG. 6, the oven according to the present invention includes: a manipulation part 51 for allowing a user to input his selections; a controller 52 for determining the selections inputted through the manipulation part 51 and controlling an operation state of the oven; a display 53 for displaying the operation state of the oven to a user; and a plurality of heaters 54, 55, 56, and 57 for directly heating the inner space of a cavity under control of the controller 52.

The manipulation part 51 includes a button switch or a dial switch for determining whether to operate an ohmic heater, which is one of heaters of the oven. The operation of the ohmic heater may be selectively on/off by the operation of the switch.

As described above, the plurality of heaters 54, 55, 56, and 57 may include an upper heater 54, a lower heater 55, a convection heater 56, and the ohmic heater 57. The ohmic heater 57 may be considered indispensable according to the sprit of the present invention. On the other hand, the other heaters may not be indispensable but be selectively used depending on the specification of the oven. The controller 52 may control the amount of heat applied to food by the ohmic heater 57 using at least an output regulator such as the transformer 31. Also, when the ohmic heater 57 operates, a cooking time of the food becomes shorter than when the ohmic heater 57 does not operate.

Figure 7:
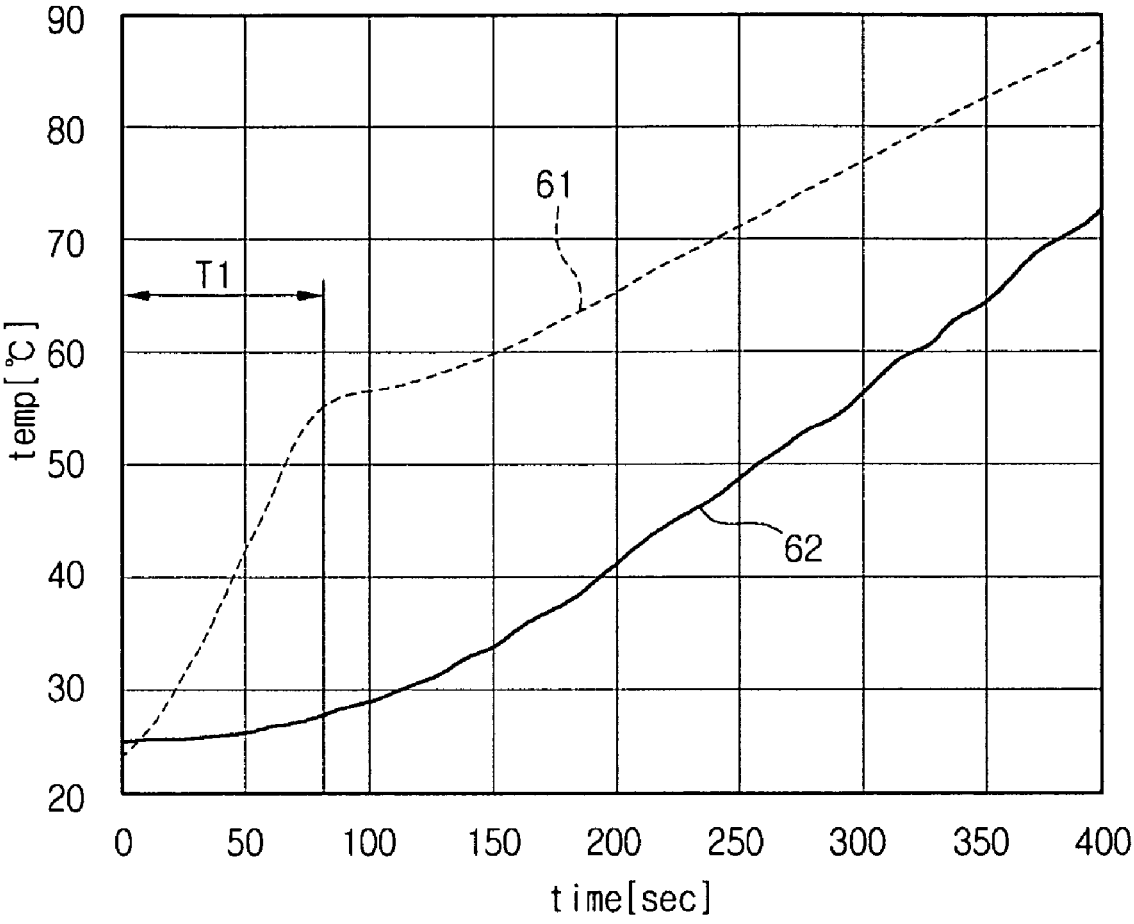
FIG. 7 is a graph plotting temperature changes of food when an ohmic heater operates and when an ohmic heater does not operate.

FIG. 7 is a graph plotting temperature changes of food when an ohmic heater operates and when an ohmic heater does not operate. Referring to FIG. 7, a curve 61 is a temperature curve obtained by averaging temperatures measured at nine points inside and outside a ham on the condition that the oven operates such that the upper heater 54 applies heat with 5,000 watt, and simultaneously, the ohmic heater 57 applies heat with 350 watt for a predetermined period of time T1, and then only the ohmic heater 57 is off. A curve 62 is a temperature curve obtained for the case where the operation of the ohmic heater 57 is stopped and only the upper heater 54 applies heat with 5,000 watt. Of course, the temperatures have been measured in the same manner for the two curves 62 and 61.

Observation of the ham's temperature curve under the described oven's operation condition shows that food is far more swiftly heated on the whole when heating is simultaneously performed by both the ohmic heater 57 and the upper heater 54. Furthermore, a result of the temperature curve shows that a remarkable improvement in cooking performance is obtained in view of the power (350 watt) applied to the ohmic heater, which is much smaller than that applied to the upper heater.

Referring to FIG. 6, when the food container 40 constituting the ohmic heater 57 is mounted, the controller 52 may also control the display 53 by a user's manipulation of the manipulation part 51 to inform a user of the ohmic heater 57's operation state using a predetermined display form. For example, a display window consisting of a liquid crystal display (LCD) or a light-emitting diode (LED) is separately formed in the display 22 to display light or characters thereon while the operation of the ohmic heater is performed. Furthermore, the display window may inform a user that power is currently applied to the ohmic heater 57, so that a user handles the oven more carefully when handing the oven, for a user may get an electric shock when a user grips the food container 40 during application of electricity. Also, it is possibly to more enhance a user's safety by allowing the door 2 of the oven to be forcibly locked while the ohmic heater 57 operates.

Also, since a cooking time of food can be more shortened when the ohmic heater 57 operates, a user manipulates the manipulation part 51 to operate the ohmic heater 57, and simultaneously, the shortening of the food's cooking time is displayed on the display 53, so that a user may estimate the food's cooking time more accurately and cook the food.

Also, it has been clearly understood with reference to FIG. 7 that the amount of power applied to the ohmic heater 57 is much smaller than that applied to the other heaters on the condition that the same heating performance for the food is obtained. Furthermore, the amount of power applied to the ohmic heater 57 may be controlled depending on the state and kind of food.

The above-described oven and the heating unit of the oven according to the present invention may be easily realized through various modifications within the scope of the sprit of the present invention. The various modifications will be described in detail below.

First, the socket 30 may be provided in the lateral side, not the rear side of the cavity, and a pair of sockets may not be spaced from each other but formed at one position together.

Also, though the conductor 46 is illustrated to extend through the inner space of the food container 40, the conductor 46 may be fixed to the outer surface of the food container or may be provided in different manners.

Also, the number of electrodes is not limited to the illustrated number but may change depending on food, and may be large in order to enhance uniform heating performance for the food.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An oven comprising:

a cavity where a high temperature environment is formed;

a heater that heats an inside of the cavity through radiation or convection;

a food container mounted within the cavity and in which food is contained; and an ohmic heater formed in the food container, the ohmic heater allowing power to be supplied to the food to directly heat the foods, wherein the ohmic heater comprises at least a pair of electrode parts provided on a bottom of the food container in order to contact a bottom surface of the food, and the electrode parts are separated by a slit in the bottom of the food container configured to prevent a short circuit.

2. The oven according to claim 1, wherein the ohmic heater is operated by an alternating current.

3. The oven according to claim 1, wherein the ohmic heater comprises a plug provided on one side of the food container, and the electrode parts are connected to the plug and provided on the bottom of the food container.

4. The oven according to claim 3, wherein the electrode parts are connected to a conductor received within the plug.

5. The oven according to claim 3, further comprising a socket formed in one side of the cavity and coupled to the plug.

6. The oven according to claim 1, further comprising:

a power supply that supplies power to the ohmic heater;

a transformer connected to the power supply, the transformer varying the power supplied to the ohmic heater; and a controller that controls the power varying by the transformer.

7. The oven according to claim 1, further comprising:

a display that displays an operation state of the ohmic heater; and an ohmic heating button that inputs an ohmic heating operation command.

8. The oven according to claim 7, wherein the display comprises a liquid crystal display device or a light-emitting diode.

9. The oven according to claim 1, further comprising a door automatically closed while the ohmic heater operates.

10. An oven comprising:

a cavity having a cooking space in an inside thereof;

a transformer provided to an outside of the cavity, the transformer transforming a voltage of a power source applied from an outside;

a pair of first connectors connected to an output terminal of the transformer and formed on a wall constituting the cavity;

a food container provided to the inside of the cavity and where food is contained;

a pair of second connectors formed in one side of the food container and selectively connected with the first connectors, to receive power; and at least a first array of electrodes and a second array of electrodes connected with the second connectors and separately formed in the food container, the electrodes configured to contact food to allow the food to be cooked by the self-resistance of the food.

11. The oven according to claim 10, further comprising a protector to selectively open and close an opening of the first connectors.

12. The oven according to claim 11, wherein the protector is rotatably mounted in the cavity to allow the second connectors to be selectively connected with the first connectors.

13. The oven according to claim 10, wherein the electrodes protrude from the bottom of the food container or are closely attached on the bottom of the food container to allow a current to flow through the food.

14. The oven according to claim 10, wherein the electrodes have a protuberance shape and are configured to be inserted into the food.

15. The oven according to claim 10, wherein the electrodes comprise a plurality of lines arranged in the bottom of the food container and are configured to contact the food.

16. The oven according to claim 10, wherein the electrodes comprise an element having a plane shape closely attached on the bottom of the food container and configured to contact the food.

17. The oven according to claim 10, further comprising a conductor that connects the electrodes with the plug.

18. An oven comprising:

a cavity;

a food container received within the cavity and on which food is seated, wherein at least two arrays of electrodes separated from each other by a slit provided in a bottom of the food container;

an ohmic heater provided in the food container and allowing food to be cooked by the self-resistance of the food;

a display that displays an operation state of the ohmic heater; and a manipulation part that allows an operation of the ohmic heater to start.

19. The oven according to claim 18, wherein the manipulation part comprises a button or a dial switch.

20. The oven according to claim 18, wherein a front opening of the cavity is selectively opened/closed by a door, and the door is forcibly closed when the ohmic heater starts to operate.

21. A heating unit of an oven, comprising:

a pair of first connectors formed in one side of a cavity and to which power is applied;

a food container mounted within the oven;

a pair of second connectors formed in one side of the food container and aligned with the first connectors; and electrodes connected to each of the second connectors, the electrodes protruding from the bottom of the food container and separated by a slit that prevents a short circuit between the electrodes, wherein all or part of the electrodes are configured to contact food to apply a voltage to the food seated on the food container and the food is cooked by the self-resistance of the food.

22. The heating unit of claim 21, wherein the food container includes embossing portions embossed from both ends of the slit.

23. The heating unit of claim 21, further comprising:

a transformer connected with the first connectors, the transformer controlling the amount of power applied to the first connectors; and a controller that controls an output power of the transformer to allow an appropriate power to be supplied to the first connectors depending on an object to be cooked.

24. A heating unit of an oven, comprising:

a food container movably mounted in an inside of the oven;

a pair of connectors formed in one side of the food container, to receive power from the oven;

a pair of electrodes, each being electrically connected to a respective one of the pair of connectors and configured to contact food contained in the food container, to apply a voltage to the food, wherein each electrode is aligned and separated by a slit; and a short-circuit prevention element provided in the food container, the short-circuit preventing element preventing short circuit between the electrodes.

* * * * *